US006640910B2

(12) United States Patent
Grupping

(10) Patent No.: US 6,640,910 B2
(45) Date of Patent: Nov. 4, 2003

(54) LONG GAUGE ROLLER VANE DRILLING MOTOR

(75) Inventor: Arnold Willem Josephus Grupping, Aerdenhout (NL)

(73) Assignee: Ultidrill B.V., Aerdenhout (NL)

( * ) Notice: Subject to any disclaimer, the term of this patent is extended or adjusted under 35 U.S.C. 154(b) by 0 days.

(21) Appl. No.: 10/170,150

(22) Filed: Jun. 12, 2002

(65) Prior Publication Data

US 2002/0148650 A1 Oct. 17, 2002

Related U.S. Application Data

(63) Continuation of application No. PCT/NL00/00010, filed on Jan. 6, 2000.

(51) Int. Cl.[7] ..... E21B 4/02; E21B 7/04

(52) U.S. Cl. ..... 175/107; 175/75; 175/61; 418/184; 418/188

(58) Field of Search ..... 175/75, 107, 100, 175/325.1, 61; 418/184, 187, 188, 183

(56) References Cited

U.S. PATENT DOCUMENTS 3,088,529 A * 5/1963 Cullen et al. ..... 175/107
4,025,248 A * 5/1977 Richards et al. ..... 418/184
4,274,497 A * 6/1981 Willis et al. ..... 175/100
4,862,974 A 9/1989 Warren et al.
4,880,066 A * 11/1989 Steiginga et al. ..... 175/75
5,733,113 A * 3/1998 Grupping ..... 418/188
5,853,053 A 12/1998 Gilchrist et al.
5,941,323 A * 8/1999 Warren ..... 175/74
6,302,666 B1 * 10/2001 Grupping ..... 418/188

FOREIGN PATENT DOCUMENTS

EP 0 427 437 A1 5/1991
EP 0 554 977 A1 8/1993
WO WO 99/20904 4/1999

* cited by examiner

*Primary Examiner*—David Bagnell
*Assistant Examiner*—T. Shane Bomar
(74) *Attorney, Agent, or Firm*—Hoffmann & Baron, LLP

(57) ABSTRACT

A system for downhole drilling and coring includes a roller vane motor for driving a drill bit. The motor has a single jacket with a lower end and an upper end and being embodied such that all drilling fluid passes inside the jacket to the drill bit. The system further has a bent sub connected to the upper end of the motor. The jacket has outwardly projecting curved members forming recesses therebetween for the passage of return drilling fluid, the curved members creating a circular surface having a diameter approximately equal to that of the drill bit. The curved members as well as the recesses therebetween each extend in longitudinal direction over the full length of the jacket of the motor.

5 Claims, 3 Drawing Sheets

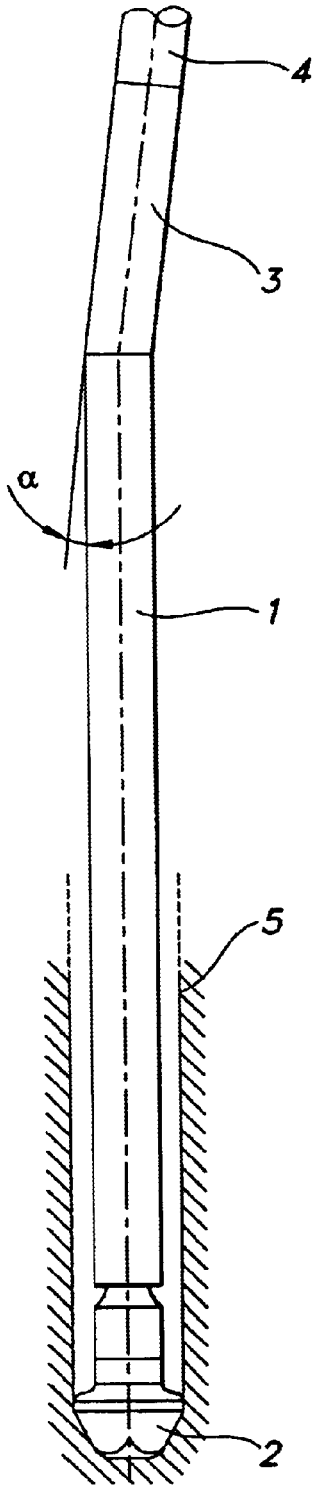
FIG. 1
(Prior art)
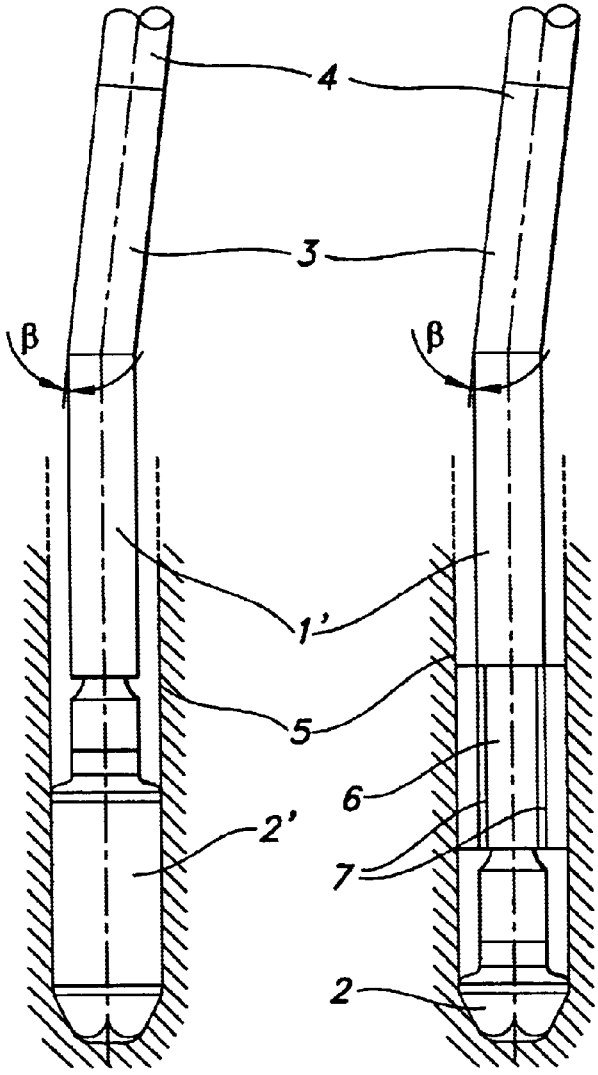
FIG. 2a
(Prior art)
FIG. 2b
(Prior art)

LONG GAUGE ROLLER VANE DRILLING MOTOR

CROSS-REFERENCE TO RELATED APPLICATION

This is a continuation of PCT/NL00/00010 filed Jan. 6, 2000, herein incorporated by reference.

FIELD OF THE INVENTION

The invention relates to a drilling motor and a system and method for drilling curved boreholes.

BACKGROUND OF THE INVENTION

To drill curved boreholes, it is known to use a system as shown in FIG. 1 of the drawing. A downhole drilling motor 1 is connected at its lower end to a drill bit 2 and at its upper end by means of a bent sub 3 with bend angled to non-rotating drillpipe 4. Drilling fluid is pumped down the drillpipe 4 to drive the drilling motor 1 that rotates the drill bit 2. The drilling fluid passes through the drill bit 2 to cool and lubricate it and to carry the drill cuttings to the surface through the annular space between the drillpipe 4 and the borehole wall 5. The curvature of the borehole is obtained with the bent sub 3, that causes the drillpipe 4 not only to exert a longitudinal force on the drill bit 2, but also a sideways force. To obtain a curvature in the desired direction at the start of the curved borehole section, the bent sub 3 must be orientated in the desired direction.

Conventionally, the downhole drilling motor 1 is a positive displacement motor (PDM) based on the Moineau principle: A rotor with a single external helix rotates inside a stator containing an internal double elastomeric helix. This arrangement creates a series of cavities. When drilling fluid is pumped down the space between rotor and stator, these cavities progress downward, turning the rotor.

The problem of borehole spiralling in curved boreholes can be eliminated or minimized by using systems as shown in FIG. 2 of the drawing. A shorter downhole positive displacement drilling motor 1' is directly attached to a long gauge bit 2' (FIG. 2*a*) or is attached to a short gauge bit 2 by means of a long gauge sub 6, at its circumference equipped with one or more longitudinal recesses 7 for passage of the return drilling fluid back to the surface (FIG. 2*b*). These short downhole positive displacement drilling motors are preferably of the roller vane type with single jacket, with all the drilling fluid passing inside this jacket to the drill bit, as described in WO 99/20904 (PCT/NL98/00598), which give a similar performance as the much longer Moineau drilling motors.

As a result, a curved borehole can be drilled with the same radius of curvature with a much smaller bend angle in the bent sub 3. In that way, the problem of too much sideways force on the drill bit is eliminated and little or no spiralling occurs in the curved borehole section.

A problem with this system of curved drilling is that, when using the rather long downhole drilling motors of the Moineau type, the curved section is somewhat spiral-shaped, which slows down the drilling process. To solve this problem, attempts have been made to stabilize the drill bit by placing a long gauge sub between the drill bit and the drilling motor, or by using long gauge drill bit. Both methods failed, because it proved impossible to start or retain a borehole of the desired curvature under these circumstances.

SUMMARY OF THE INVENTION

The invention provides a system for downhole drilling and coring, said system comprising a roller vane motor for driving a drill bit, said motor having a single jacket with a lower end and an upper end and being embodied such that all drilling fluid passes inside said jacket to the drill bit.

The system further has a bent sub connected to the upper end of the motor. The jacket is provided with outwardly projecting curved members forming recesses therebetween for the passage of return drilling fluid, the curved members creating a circular surface having a diameter approximately equal to that of the drill bit.

The curved members as well as the recesses therebetween each extend in longitudinal direction over the full length of the jacket of the motor.

Preferably the curved members are extended to beneath the lower end of the jacket to near the drill bit.

Preferably the motor has wing deflector cams forming part of the jacket, a longitudinal recess being provided at the outer surface of the jacket opposite the wing deflector cam. Also the jacket has above and below the wing deflector cams an internal diameter approximately equal to that of the wing deflector cams.

The invention also relates to a method for drilling and coring curved and horizontal borehole sections, wherein use is made of a system according to one or more of the preceding claims and wherein the bent sub is connected to a non-rotating drill pipe.

The invention also relates to a roller vane motor for driving a drill bit, said motor having a single jacket with a lower end and an upper end and being embodied such that all drilling fluid passes inside said jacket to the drill bit, the jacket being provided with outwardly projecting curved members forming recesses therebetween for the passage of return drilling fluid, the curved members creating a circular surface having a diameter approximately equal to that of the drill bit.

The curved members as well as the recesses therebetween each extend in longitudinal direction of the jacket of the motor, and in that the motor has wing deflector cams forming part of the jacket, each longitudinal recess being provided at the outer surface of the jacket opposite a wing deflector cam.

The jacket above and below the wing deflector cams has an internal diameter approximately equal to that of the wing deflector cams.

BRIEF DESCRIPTION OF THE DRAWINGS

FIG. 1 shows a prior art system for drilling curved boreholes;

FIGS. 2*a* and 2*b* show systems for drilling curved boreholes according to the prior art.

DETAILED DESCRIPTION OF THE INVENTION

Figure 3A:
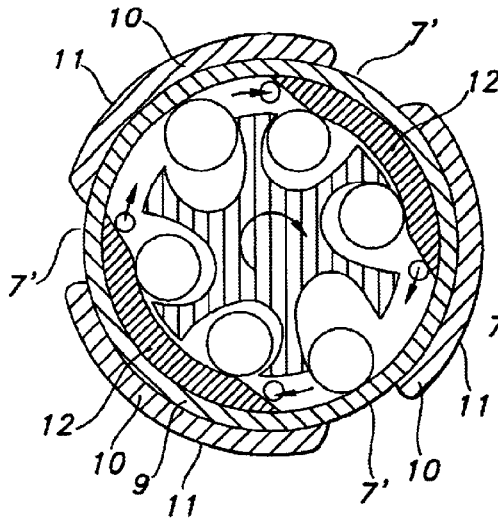
FIG. 3 shows transverse sectional views from above of embodiments of a short downhole positive displacement drilling motor of the present invention.

The present invention provides an adapted even shorter downhole positive displacement roller vane drilling motor with single jacket for drilling borehole sections of the same radius of curvature with a smaller bend angle in the bent sub above the motor, or for drilling borehole sections of smaller radius of curvature with the same bend angle in the bent sub above the motor. To this end, the motor is adapted to take over the stabilizing function of the long gauge bit or the long gauge sub shown in FIG. 2.

The present invention will be elucidated below in more detail with reference to the drawing, showing in: FIG. 3 transverse sectional views from above of embodiments of a short downhole positive displacement drilling motor of the present invention; FIG. 4 systems for drilling curved borehole sections in which short downhole drilling motors of the present invention are used; FIG. 5 longitudinal cross sections of embodiments of a short downhole positive displacement drilling motor of the present invention.

Referring to FIG. 3*a*, a single-jacket roller vane drilling motor as described in WO 99/20904 (PCT/NL98/00598) has its jacket 9 provided at its circumference with one or more curved members 10 in such a way that a new, larger circular outside surface 11 is created with a diameter approximately equal to that of the drill bit 2 below, and whereby one or more longitudinal recesses 7' are created for passage of the drilling fluid back to the surface. The curved members 10 may start below the lower end of the motor or at its lower end and may or may not extend to its upper end. If the curved members 10 start below the lower end of the motor, the jacket) of the motor, and therefore the recesses 7', may also be extended below the lower end of the motor.

Figure 3B:
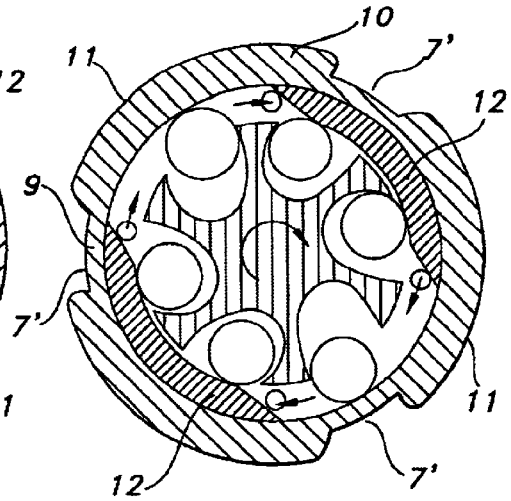

In the embodiment shown in FIG. 3*b*, the recesses 7' are created in the motor jacket 9 itself, this jacket being of increased thickness. Here also, the increased thickness with recesses 7' may start at or below the lower end of the motor and may or may not extend to its upper end.

Figure 3C:
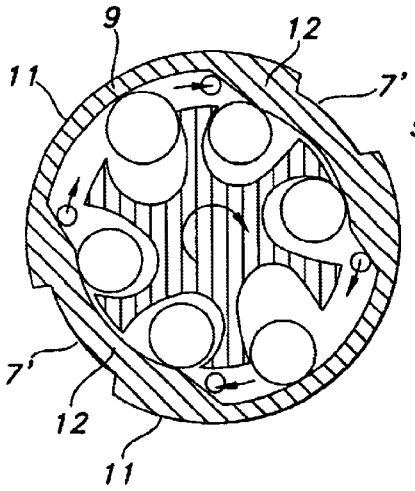

In the embodiment shown in FIG. 3*c*, the wing deflector cams 12 of the motor are part of the motor jacket 9 and the recesses 7' are created in the motor jacket 9, opposite these wing deflector cams 12. In this embodiment, the recesses 7' must run the length of the motor, so that the motor jacket 9 above and below the wing deflector cams 12 must have an internal diameter approximately equal to that of the wing deflector cams 12.

FIG. 4 shows three schematic longitudinal side views of systems for drilling curved borehole sections in which motors of the present invention are used.

Figures 4A, 4B, 4C:
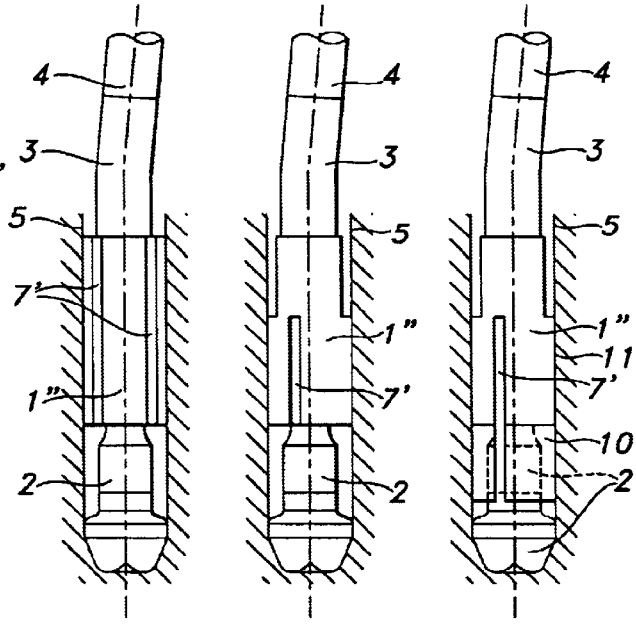
FIG. 4 shows systems for drilling curved borehole sections in which short downhole drilling motors of the present invention are used.

In FIG. 4*a* a short downhole drilling motor 1" of the present invention is attached at its lower end to a drill bit 2 and at its upper end to a bent sub 3 and further to non-rotating drillpipe 4. The long gauge part of the motor with recesses 7' for the drilling fluid runs the full length of the motor.

In FIG. 4*b* a short downhole drilling motor 1" of the present invention is attached at its lower end to a drill bit 2 and at its upper end to a bent sub 3 and further to non-rotating drillpipe 4. The long gauge part of the motor with recesses 7' for the drilling fluid extends only partly up the motor.

In FIG. 4*c* a short downhole drilling motor 1" of the present invention is attached at its lower end to a drill bit 2 and at its upper end to a bent sub 3 and further to non-rotating drillpipe 4. The long gauge part of the motor is extended below the motor body to near the cutting edge of the drill bit 2 by extending the curved members 10. This improves the stabilizing effect of the motor-bit combination.

FIG. 4 also illustrates that the system from bit bottom to the bent sub above the short downhole drilling motor according to the present invention is much shorter than known stabilized systems shown in FIG. 2. Firstly, (part of) the motor takes over the stabilizing function of the long gauge section of the drill bit or the long gauge sub. Secondly, the long gauge motor, in particular the embodiment shown in FIG. 3*c*, has a substantially larger inside diameter. As a result, for the same power input and output, it is significantly shorter.

A further reduction in the length of the motor-bit combination is possible by eliminating the open space between the cutting edge of the drill bit and the motor. This can be achieved by incorporating the drive sub of the drill bit in the lower part of the motor as shown in FIG. 5.

Figure 5A:
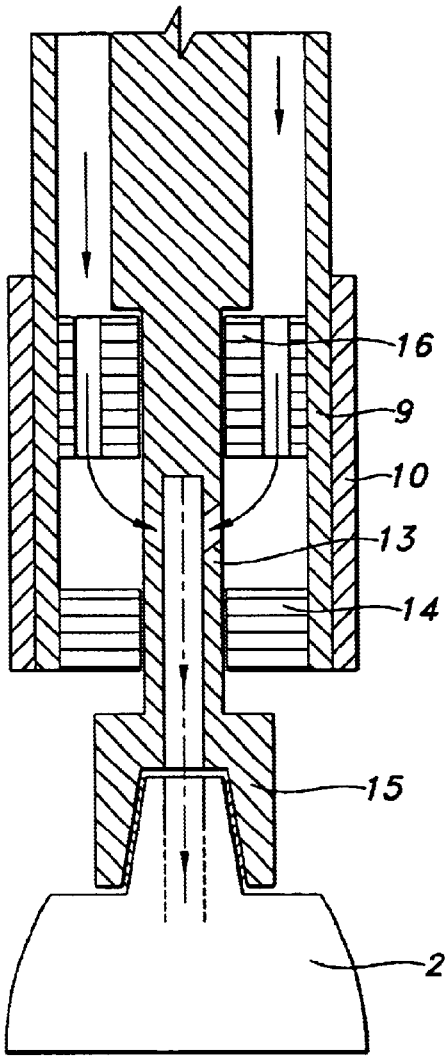
FIG 5 shows longitudinal cross sections of embodiments of a short downhole positive displacement drilling motor of the present invention.

FIG. 5*a* shows a longitudinal section of the lower part of a short roller vane drilling motor with single jacket 9 and curved members 10 outside the lower part of the motor, according to the present invention. The rotor shaft 13 passes through the sealing member 14, and the drive sub 15 for attaching the drill bit 2 is attached to the rotor shaft 13 below the sealing member 14.

Figure 5B:
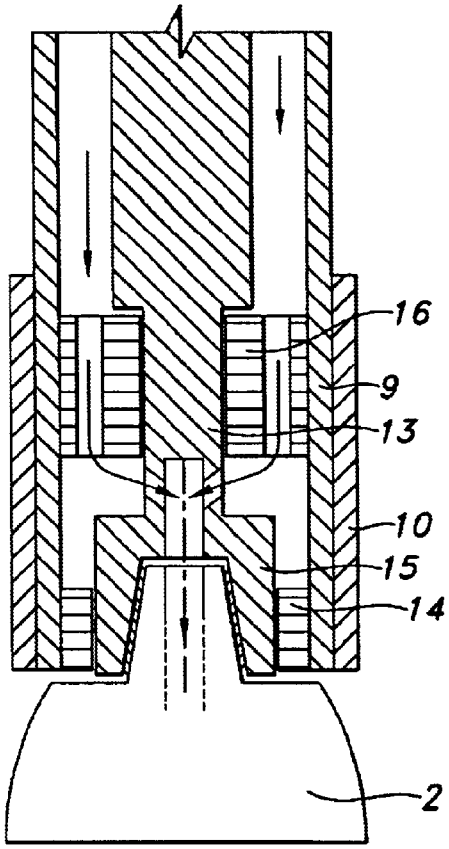

In FIG. 5*b* the drive sub 15 is attached to the rotor shaft 13 below the lower bearing housing 16 of the motor, the drive sub 15 and the sealing member 14 forming one unit.

The drilling motors according to the present invention may not only be used for deviated drilling but also for horizontal drilling and for coring purposes. The invention includes therefore within its scope systems for drilling and coring deviated and horizontal borehole sections in which drilling motors of the present invention are used, as well as methods for drilling and coring deviated and horizontal borehole sections using a drilling motor of the present invention.

What is claimed is:

1. A roller vane motor for driving a drill bit, said motor having a single jacket with a lower end and an upper end and being embodied such that all drilling fluid passes inside said jacket to the drill bit, the jacket being provided with outwardly projecting curved members forming recesses therebetween for the passage of return drilling fluid, the curved members creating a circular surface having a diameter approximately equal to that of the drill bit, wherein the curved members as well as the recesses therebetween each extend in longitudinal direction of the jacket of the motor, and in that the motor has wing deflector cams forming part of the jacket, each longitudinal recess being provided at the outer surface of the jacket opposite a wing deflector cam, and wherein the jacket above and below the wing deflector cams has an internal diameter approximately equal to that of the wing deflector cams.

2. A system for downhole drilling and coring, said system comprising a roller vane motor for driving a drill bit, said motor having a single jacket with a lower end and an upper end and being embodied such that all drilling fluid passes inside said jacket to the drill bit, said system further comprising a bent sub connected to the upper end of the motor, the jacket being provided with outwardly projecting curved members forming recesses therebetween for the passage of return drilling fluid, the curved members creating a circular surface having a diameter approximately equal to that of the drill bit, wherein the curved members as well as the recesses therebetween each extend in longitudinal direction over the full length of the jacket of the motor and further wherein the curved members are extended to beneath the lower end of the jacket to near the drill bit.

3. The system according to claim 2, wherein the motor has wing deflector cams forming part of the jacket, a longitudinal recess being provided at the outer surface of the jacket opposite the wing deflector cam, and wherein the jacket above and below the wing deflector cams has an internal diameter approximately equal to that of the wing deflector cams.

4. A system for downhole drilling and coring, said system comprising a roller vane motor for driving a drill bit, said motor having a single jacket with a lower end and an upper end and being embodied such that all drilling fluid passes inside said jacket to the drill bit, said system further comprising a bent sub connected to the upper end of the motor, the jacket being provided with outwardly projecting curved members forming recesses therebetween for the passage of return drilling fluid, the curved members creating a circular surface having a diameter approximately equal to that of the drill bit, wherein the curved members as well as the recesses therebetween each extend in longitudinal direction over the full length of the jacket of the motor, wherein the motor has wing deflector cams forming part of the jacket, a longitudinal recess being provided at the outer surface of the jacket opposite the wing deflector cam, and wherein the jacket above and below the wing deflector cams has an internal diameter approximately equal to that of the wing deflector cams.

5. The system according to claim 4, wherein the curved members are extended to beneath the lower end of the jacket to near the drill bit.

* * * * *